US010280942B2

(12) United States Patent
Jiang et al.

(10) Patent No.: US 10,280,942 B2
(45) Date of Patent: May 7, 2019

(54) CENTRIFUGAL COMPRESSOR AND WATER CHILLING UNIT HAVING THE SAME

(71) Applicant: Gree Electric Appliances, Inc. of ZHUHAI, Zhuhai, Guangdong (CN)

(72) Inventors: Nan Jiang, Zhuhai (CN); Ruixing Zhong, Zhuhai (CN); Caiyun Jiang, Zhuhai (CN); Rong Xie, Zhuhai (CN); Hongxing Wang, Zhuhai (CN); Jianfei Liu, Zhuhai (CN); Yuhui Chen, Zhuhai (CN)

(73) Assignee: GREE ELECTRIC APPLIANCES, INC. OF ZHUHAI, Zhuhai, Guangdong (CN)

( * ) Notice: Subject to any disclaimer, the term of this patent is extended or adjusted under 35 U.S.C. 154(b) by 415 days.

(21) Appl. No.: 15/037,740

(22) PCT Filed: Jul. 24, 2014

(86) PCT No.: PCT/CN2014/082956
§ 371 (c)(1),
(2) Date: May 19, 2016

(87) PCT Pub. No.: WO2015/074437
PCT Pub. Date: May 28, 2015

(65) Prior Publication Data

US 2016/0273553 A1 Sep. 22, 2016

(30) Foreign Application Priority Data

Nov. 22, 2013 (CN) ..... 2013 1 0598479

(51) Int. Cl.
*F04D 17/10* (2006.01)
*F04D 25/02* (2006.01)
(Continued)

(52) U.S. Cl.
CPC ..... *F04D 29/5846* (2013.01); *F04D 17/10* (2013.01); *F04D 25/02* (2013.01);
(Continued)

(58) Field of Classification Search
CPC ..... F04D 29/66; F04D 29/664; F04D 29/667; F04D 29/4206; F04D 29/4233;
(Continued)

(56) References Cited

U.S. PATENT DOCUMENTS 3,722,965 A * 3/1973 Gemein ..... F01D 25/166 384/114
3,736,074 A * 5/1973 Kilbane ..... F04B 39/0033 181/205
(Continued)

FOREIGN PATENT DOCUMENTS

CN 1152344 A 6/1997
CN 101265917 A 9/2008
(Continued)

OTHER PUBLICATIONS

Warnock, A.C.C. "Factors Affecting Sound Transmission Loss" Canadian Building Digest, Jul. 1985 accessed from https://nparc.nrc-cnrc.gc.ca/eng/view/accepted/?id=6f04ffd7-4531-4ea2-ada6-3df32c9674ee.*
(Continued)

*Primary Examiner* — Igor Kershteyn
*Assistant Examiner* — Topaz L. Elliott
(74) *Attorney, Agent, or Firm* — Li & Cai Intellectual Property (USA) Office

(57) ABSTRACT

The invention discloses a centrifugal compressor and a water chilling unit having the same. The centrifugal compressor includes an impeller (2), a diffuser (3), a volute (8) and an exhaust diffuser pipe (9), the diffuser (3) including a pressurization passage, air flowing through the impeller (2)
(Continued)

entering an inlet of each pressurization passage, the volute (8) being configured to collect the air pressurized by the diffuser (3), the exhaust diffuser pipe being communicated with the volute, and an extending direction of the exhaust diffuser pipe inclining downwards with respect to a horizontal plane. The extending direction of the exhaust diffuser pipe communicated with the volute inclines downwards with respect to the horizontal plane, so that noise and airflow losses of high-temperature and high-pressure air in the exhaust diffuser pipe expelled from the centrifugal compressor due to bending of the pipe can be reduced, and the noise can be effectively reduced.

16 Claims, 2 Drawing Sheets

(51) Int. Cl.

| | |
|---|---|
| ***F04D 29/42*** | (2006.01) |
| ***F04D 29/44*** | (2006.01) |
| ***F04D 29/58*** | (2006.01) |
| ***F04D 29/66*** | (2006.01) |
| ***F25B 31/02*** | (2006.01) |
| ***F04D 29/063*** | (2006.01) |

(52) U.S. Cl.
CPC ..... *F04D 29/4206* (2013.01); *F04D 29/44* (2013.01); *F04D 29/441* (2013.01); *F04D 29/444* (2013.01); *F04D 29/664* (2013.01); *F04D 29/667* (2013.01); *F25B 31/026* (2013.01); *F04D 29/063* (2013.01); *F05B 2250/502* (2013.01); *F05B 2260/96* (2013.01); *F05D 2250/52* (2013.01); *F05D 2260/4031* (2013.01)

(58) Field of Classification Search
CPC .... F04D 29/063; F04D 17/10; F05D 2250/52; F05B 2250/502; F05B 2260/96
See application file for complete search history.

(56) References Cited

U.S. PATENT DOCUMENTS

| | | | | |
|---|---|---|---|---|
| 4,014,179 | A * | 3/1977 | Iles | B64D 13/06 123/563 |
| 4,687,411 | A * | 8/1987 | Maeda | F16C 35/02 384/538 |
| 6,238,179 | B1 | 5/2001 | Wunderwald et al. | |
| 6,857,338 | B2 * | 2/2005 | Tsergas | F16H 57/028 74/421 A |
| 8,037,713 | B2 * | 10/2011 | Haley | F04D 17/122 417/423.1 |
| 8,397,534 | B2 * | 3/2013 | Doty | F04D 29/284 417/366 |
| 8,616,836 | B2 * | 12/2013 | Blair | F04D 29/444 415/148 |
| D754,557 | S * | 4/2016 | Wang | D11/9 |
| D754,754 | S * | 4/2016 | Wang | D15/9 |
| 2009/0205360 | A1 | 8/2009 | Haley et al. | |
| 2009/0229280 | A1 * | 9/2009 | Doty | F04D 29/284 62/115 |
| 2012/0014788 | A1 * | 1/2012 | Blair | F04D 29/444 415/208.2 |
| 2016/0195106 | A1 * | 7/2016 | Uehara | F04D 29/422 415/119 |

FOREIGN PATENT DOCUMENTS

| | | | | |
|---|---|---|---|---|
| CN | 201377469 | Y * | 1/2010 | |
| CN | 203584843 | U | 5/2014 | |
| JP | 54-33949 | * | 3/1979 | |
| JP | 58214697 | A * | 12/1983 | F04D 29/5846 |
| JP | 60159266 | U * | 10/1985 | |
| JP | 61166193 | U * | 10/1986 | |
| JP | 07103162 | A * | 4/1995 | |
| JP | 2002155896 | A * | 5/2002 | |
| JP | 2008231933 | A * | 10/2008 | F04D 25/163 |
| JP | 2011-515606 | A | 5/2011 | |
| RU | 2138692 | C1 | 9/1999 | |
| SU | 1622734 | A1 | 5/1973 | |
| SU | 772495 | A3 | 10/1980 | |
| WO | WO 2008/124454 | A1 | 10/2008 | |

OTHER PUBLICATIONS

Grimsby ("Air cycle refrigeration") accessed from http://www.grimsby.ac.uk/documents/frperc/research/aircycle_research.pdf on Aug. 20, 2018.*

Russia Patent Office (FIPS), Office action dated Mar. 2, 2018 regarding the counterpart Russia patent application of the present application.

European Patent Office, European Patent Search Report dated Jun. 27, 2017 regarding the counterpart European patent application of the present application.

* cited by examiner

CENTRIFUGAL COMPRESSOR AND WATER CHILLING UNIT HAVING THE SAME

TECHNICAL FIELD OF THE INVENTION

The invention relates to the field of compressors, and in particular to a centrifugal compressor and a water chilling unit having the same.

BACKGROUND OF THE INVENTION

A central air conditioner, particularly serving as a current centrifugal water chilling unit having a maximum refrigeration capacity, generates higher noises inevitably in a running process. These noises seriously pollute a surrounding environment, and bring a great harm to device users and maintainers. People, frequently located in the high-decibel environment, will be very impatient and irritated. In order to maintain the physical and psychological health and the living environment of people, noise reduction is imperative.

The noises generated in the running process of the centrifugal water chilling unit are substantially composed of three parts: firstly, mechanical noises generated in a meshing process of transmission parts of a centrifugal compressor in the unit; secondly, electromagnetic noises generated in the running process of a motor driving the unit to operate and noises generated by an oil pump supplying oil to a compressor bearing; and thirdly, airflow noises generated by an airflow in a compressor air suction pipeline, an internal flow passage and an exhaust diffuser pipeline.

The mechanical noises generated by meshing of the transmission parts inside the centrifugal compressor are generally reduced by using single methods for thickening the wall of a gear box and improving the machining precision of a gear, the noise reduction methods are relatively single, and the effects are limited.

SUMMARY OF THE INVENTION

The invention aims to provide a noise-reduced centrifugal compressor and a water chilling unit having the same.

In order to achieve the aim, the invention provides a centrifugal compressor, which may comprise: an impeller; a diffuser, the diffuser comprising a pressurization passage, and air flowing through the impeller entering an inlet of the pressurization passage; a volute, configured to collect the air pressurized by the diffuser; and an exhaust diffuser pipe, communicated with the volute, an extending direction of the exhaust diffuser pipe inclining downwards with respect to a horizontal plane.

Furthermore, an angle between the extending direction of the exhaust diffuser pipe and the horizontal plane is A, wherein $15° \leq A \leq 90°$.

Furthermore, the centrifugal compressor further comprises a coolant passage configured to import a coolant from the outside, the coolant passage comprising a liquid spraying hole provided at an inlet end of the pressurization passage.

Furthermore, a liquid spraying direction of the liquid spraying hole is perpendicular to a flowing direction of the air in the pressurization passage.

Furthermore, the centrifugal compressor further comprises: a drive motor; a gear box; a spindle, mounted at the gear box, one end of the spindle being connected with the impeller; a first gear, mounted at the spindle; a drive shaft, mounted at the gear box, the drive shaft being in drive connection with the drive motor; a second gear, mounted at the drive shaft and meshing with the first gear; and a lubricating system, lubricating oil of the lubricating system being contained in a lower cavity of the gear box.

Furthermore, the centrifugal compressor further comprises a three-oil-wedge bearing configured to mount the spindle and/or the drive shaft at the gear box.

Furthermore, the coolant passage comprises a first flow guide hole provided in an inner of a side wall of the gear box and communicated with the liquid spraying hole.

Furthermore, the diffuser further comprises a first partition plate and a second partition plate parallel to the first partition plate, the first partition plate comprising an annular base plate abutting against an outer side of the side wall of the gear box and a plurality of flow guide plates vertically provided on a surface, opposite to the side wall of the gear box, of the base plate, the flow guide plates being uniformly provided in a circumferential direction of the base plate, and every two adjacent flow guide plates forming the corresponding pressurization passage, and the coolant passage comprises a plurality of the liquid spraying holes corresponding to a plurality of pressurization passages, each pressurization passage at least corresponding to one liquid spraying hole.

Furthermore, the coolant passage further comprises a second flow guide hole configured to communicate the liquid spraying hole with the first flow guide hole, the second flow guide hole comprising a first hole-section extending from an interior of the base plate to the side wall of the gear box and second hole-sections configured to communicate the liquid spraying hole with the first hole-section; and the coolant passage further comprises an elongated slot which is provided at the outer side of the side wall of the gear box or which is provided at the surface, abutting against the outer side of the side wall of the gear box, of the first partition plate and configured to communicate the second hole-sections, the elongated slot being communicated with the first flow guide hole.

Furthermore, at least some of box walls forming the gear box are double-layer walls.

Furthermore, each double-layer wall comprises an inner sound insulation wall and an outer sound insulation wall provided at an outer side of the inner sound insulation wall at an interval, the thickness of the outer sound insulation wall is D, and the thickness of the inner sound insulation wall is H, where D is greater than H.

Furthermore, D is greater than H+5 mm.

Furthermore, D is greater than 20 mm and less than 30 mm, and H is greater than 15 mm and less than 25 mm.

According to another aspect of the invention, a water chilling unit is provided, which comprises an above-mentioned centrifugal compressor.

By means of the technical solutions of the invention, the extending direction of the exhaust diffuser pipe communicated with the volute inclines downwards with respect to the horizontal plane, so that noise and airflow losses of high-temperature and high-pressure air in the exhaust diffuser pipe expelled from the centrifugal compressor due to bending of the pipe can be reduced, and the noise can be reduced effectively.

BRIEF DESCRIPTION OF THE DRAWINGS

The specification drawings forming a part of the invention are intended to provide further understanding of the invention. The schematic embodiments and descriptions of the invention are intended to explain the invention, and do not form improper limits to the invention. In the drawings.

Wherein, all drawing marks represent: 1, air suction chamber; 2, impeller; 21, air passage; 3, diffuser; 31, pressurization passage; 32, first partition plate; 33, second partition plate; 4, coolant passage; 41, liquid spraying hole; 42, first flow guide hole; 43, second flow guide hole; 431, first hole-section; 432, second hole-section; 44, coolant inlet; 5, gear box; 51, inner sound insulation wall; 52, outer sound insulation wall; 6, spindle; 7, first gear; 8, volute; and 9, exhaust diffuser pipe.

DETAILED DESCRIPTION OF THE EMBODIMENTS

It is important to note that the embodiments of the invention and the characteristics in the embodiments can be combined under the condition of no conflicts. The invention is described below with reference to the drawings and the embodiments in detail.

Figure 1:
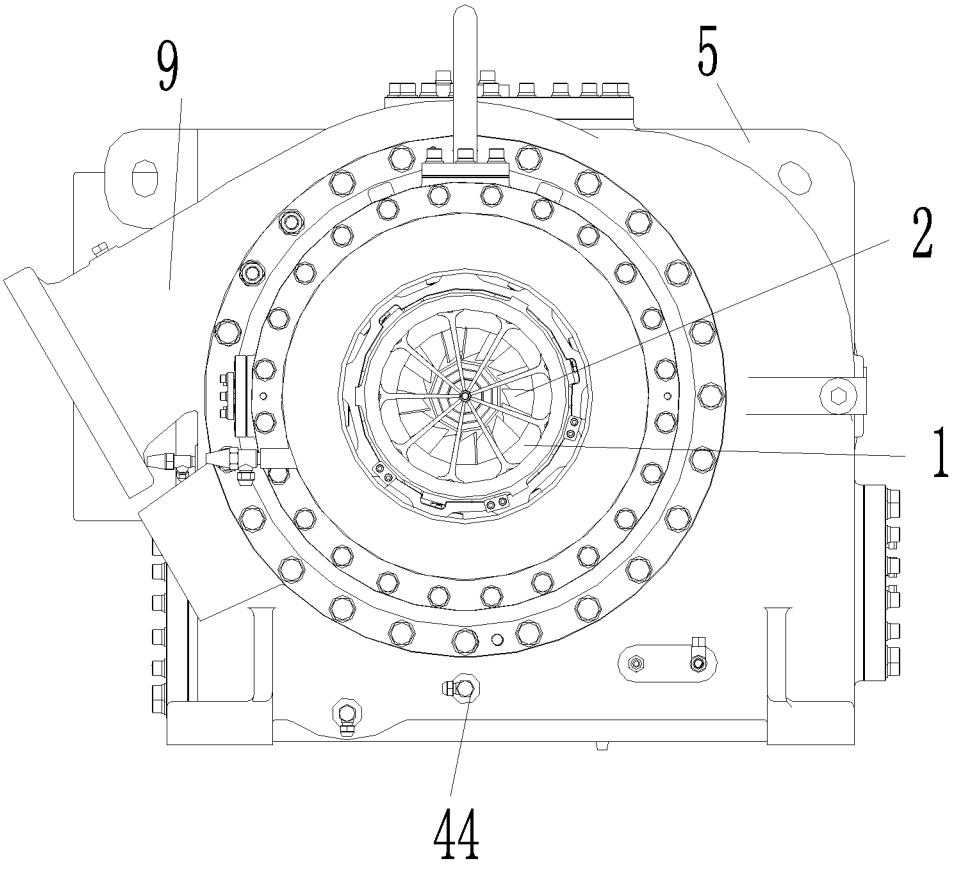
FIG. 1 shows a structural diagram of a centrifugal compressor according to an embodiment of the invention.
Figure 2:
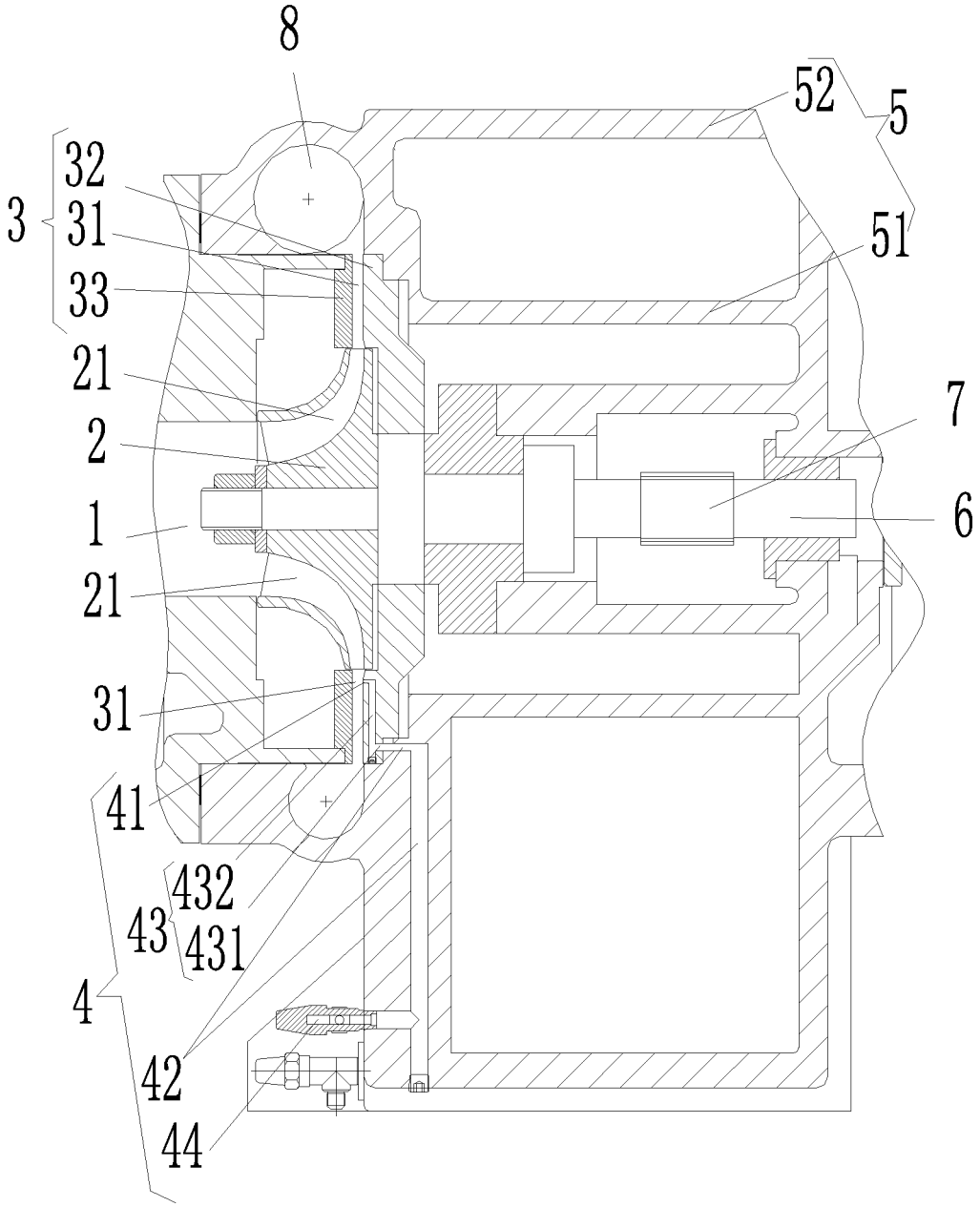
FIG. 2 shows a structural section view of a centrifugal compressor according to an embodiment of the invention.

As shown in FIG. 1 and FIG. 2, a centrifugal compressor in an embodiment comprises an air suction chamber 1, an impeller 2, a diffuser 3, a volute 8 and an exhaust diffuser pipe 9. The air suction chamber 1 is configured to import air to be compressed. The impeller 2 is configured to accelerate the air to be compressed, and a space between every two adjacent blades of the impeller 2 is an air passage 21. An air inlet end of each air passage 21 is communicated with the air suction chamber 1. The diffuser 3 comprises a pressurization passage 31 configured to compress the accelerated air to be compressed. The pressurization passage 31 is communicated with an air outlet end of the air passage 21 of the impeller 2. Air flowing through the impeller 2 enters an inlet of the pressurization passage 31. The volute 8 is configured to collect the air pressurized by the diffuser 3. The exhaust diffuser pipe 9 is communicated with the volute 8 and is configured to export the air compressed by the centrifugal compressor. An extending direction of the exhaust diffuser pipe 9 inclines downwards with respect to a horizontal plane.

Firstly, the air to be compressed, imported into the air suction chamber 1, flows through the air passage 21 of the impeller 2, and the impeller 2 rotating at a high speed accelerates the air to be compressed in the air passage 21. Then, the accelerated air flows into the pressurization passage 31 of the diffuser 3. Finally, high-temperature and high-pressure air pressurized by the pressurization passage 31 of the diffuser 3 is collected by the volute 8 and then is expelled from the exhaust diffuser pipe 9.

The exhaust diffuser pipe 9 of the centrifugal compressor inclines downwards with respect to the horizontal plane, so that the noise and airflow losses of the high-temperature and high-pressure air in the exhaust diffuser pipe expelled from the centrifugal compressor due to bending of the pipe can be reduced.

The following table shows the comparison of noise data obtained by the horizontal arrangement of the exhaust diffuser pipe of the centrifugal compressor of which the refrigeration capacity is 1,400 KW and the 45° inclined arrangement of the exhaust diffuser pipe under the same working condition. By means of the data, it can be seen that the noise obtained by the downward inclined arrangement of the exhaust diffuser pipe is about 1 dB (A) lower than that obtained by horizontal exhaust.

TABLE 1

| noise data of exhaust diffuser pipe | | |
|---|---|---|
| | Horizontal arrangement of exhaust diffuser pipe | Downward inclined arrangement of exhaust diffuser pipe |
| Data 1 | 86.5 Db(A) | 84.8 dB(A) |
| Data 2 | 88.3 dB(A) | 87.7 dB(A) |
| Data 3 | 83.1 dB(A) | 83.9 dB(A) |
| Data 4 | 82.7 dB(A) | 81.7 dB(A) |

Preferably, an angle between the extending direction of the exhaust diffuser pipe 9 and the horizontal plane is A, wherein $15° \leq A \leq 90°$, and $15° \leq A \leq 65°$, more preferably.

Experiments prove that as an included angle A between the extending direction of the exhaust diffuser pipe 9 and the horizontal plane increases, the friction between the airflow in a flowing process and a pipe elbow decreases, and the noise will be reduced accordingly. When an exhaust opening is vertically downward, the noise is lowest. However, by comprehensively considering all factors in terms of unit pipeline arrangement, compressor entire assembly convenience and the like, the angle A is 15°-65° more preferably, 60° being most suitable.

In the embodiment, the centrifugal compressor further comprises a coolant passage 4 configured to import a coolant from the outside, and the coolant passage 4 comprises a liquid spraying hole 41 provided at an inlet end of the pressurization passage 31.

In the embodiment, a low-temperature and high-pressure liquid coolant discharged from a condenser of an air conditioning unit is sprayed to an accelerated high-temperature air expelled from the air passage 21. After the low-temperature and high-pressure liquid coolant is mixed with the accelerated high-temperature air, the liquid coolant becomes misty, and the misty coolant and the pressurized high-temperature and high-pressure air are mixed, and then enter the volute 8, thereby absorbing a high-frequency noise caused by the exhaust friction.

The flow area of the pressurization passage 31 of the diffuser 3 is gradually increased from the inlet so as to compress the air accelerated by the impeller 2. The liquid spraying hole 4 is provided at the inlet end, having the minimum flow area, of the corresponding pressurization passage 31, so as to aid in full contact between the coolant and the pressurized high-temperature and high-pressure air, thereby more effectively reducing the noise.

The centrifugal compressor in the embodiment further comprises a drive motor, a gear box 5, a spindle 6, a first gear 7, a drive shaft and a second gear. The spindle 6 is mounted at the gear box 5, and one end of the spindle 6 is connected with the impeller 2. The first gear 7 is mounted outside the spindle 6. The drive shaft is mounted at the gear box 5 and is in drive connection with the drive motor. The first gear and the second gear are located in the gear box 5.

In the embodiment, the centrifugal compressor further comprises a three-oil-wedge bearing configured to mount the spindle 6 and the drive shaft at the gear box 5. The three-oil-wedge bearing effectively improves the reliability and stability of a rotary shaft running at a high speed, thereby reducing the noise.

The centrifugal compressor in the embodiment further comprises a lubricating system, and lubricating oil of the lubricating system is contained in a lower box body of the gear box 5.

In an operating process of the centrifugal compressor, a liquid surface of the lubricating oil continuously rolls due to the operation of an oil pump of the lubricating system, and formed oil mist can be configured to lubricate the first gear 7 and the second gear in a meshing state, so that the lives of the gears are prolonged, and at the same time, the meshing stability can be improved and the noise can be reduced.

More preferably, it is necessary to guarantee that the liquid surface of the lubricating oil in the gear box 5 can not touch the first gear and the second gear, and an allowance of 20-40 mm, optimally 30 mm, should be retained. If the first gear 7 or the second gear is soaked in the lubricating oil, a loss of mechanical energy will be caused, thereby affecting the unit efficiency. Most of the lubricating oil adopted for the centrifugal compressor is synthetic fat lubricating oil which is mutually soluble with the coolant. When the lubricating oil contains a great number of coolants, the liquid level of the lubricating oil will be raised, and therefore it is necessary to set a certain distance between the first gear or the second gear and the liquid level of the lubricating oil.

The diffuser 3 in the embodiment further comprises a first partition plate 32 and a second partition plate 33 parallel to the first partition plate 32. The first partition plate 32 comprises an annular base plate abutting against an outer side of a side wall of the gear box 5 and a plurality of flow guide plates vertically provided on a surface, departing from the side wall of the gear box 5, of the base plate. The flow guide plates are uniformly provided in a circumferential direction of the base plate. Every two adjacent flow guide plates form the corresponding pressurization passage 31. The coolant passage 4 comprises a plurality of liquid spraying holes 41 corresponding to the pressurization passages 31, each pressurization passage 31 at least corresponding to one liquid spraying hole 41.

Preferably, a liquid spraying direction of the liquid spraying hole 41 is perpendicular to a flowing direction of the air in the corresponding pressurization passage 31. The air in the pressurization passage 31 flows from an inlet of a pressurization passage 31 located at an inner circle of the annular base plate to an outlet of a pressurization passage 31 at an outer circle of the annular base plate. The liquid spraying direction of the liquid spraying hole 41 is perpendicular to the flowing direction of the air in the corresponding pressurization passage 31 and is also perpendicular to the base plate of the first partition plate 32. Consequently, the liquid spraying holes 41 in the embodiment reduce the machining difficulty and improve the production efficiency.

The coolant passage 4 further comprises a second flow guide hole 43 configured to communicate the liquid spraying hole 41 with the first flow guide hole 42. The second flow guide hole 43 comprises a first hole-section 431 extending from an interior of the base plate to the side wall of the gear box 5 and second hole-sections 432 configured to communicate the liquid spraying hole 41 with the first hole-section 431. The coolant passage 4 further comprises an elongated slot which is provided at the outer side of the side wall of the gear box 5 or which is provided at the surface, abutting against the outer side of the side wall of the gear box 5, of the first partition plate 32 and configured to communicate the second hole-section 432, and the elongated slot is communicated with the first flow guide hole 42. By means of the above arrangements, the complexity of the coolant passage 4 is effectively reduced. Furthermore, the machining difficulty is reduced, and the production efficiency is improved. Furthermore, the noise of each pressurization passage 31 in the diffuser 3 can be comprehensively reduced.

In the embodiment, the coolant passage 4 further comprises a coolant inlet 44 communicated with the first flow guide holes 42 and provided on the gear box 5.

In the embodiment, the coolant passage 4 further comprises the liquid spraying holes 41 corresponding to the pressurization passages 31, each pressurization passage 31 at least corresponding to one liquid spraying hole 41.

Also preferably, each pressurization passage 31 corresponds to a plurality of liquid spraying holes 41. At least one liquid spraying hole 41 is provided at the inlet of the corresponding pressurization passage 31.

In the embodiment, at least some of box walls forming the gear box are double-layer walls. Preferably, a side wall abutting against the first partition plate 32 is single-layer, thereby aiding in providing the first flow guide holes 42 at the side wall.

Each double-layer wall comprises an inner sound insulation wall 51 and an outer sound insulation wall 52 provided on an outer side of the inner sound insulation wall 51 at an interval, the thickness of the outer sound insulation wall 52 is D, and the thickness of the inner sound insulation wall 51 is H, where D is greater than H.

Preferably, D is greater than 20 mm and less than 30 mm, and H is greater than 15 mm and less than 25 mm.

Preferably, the conditions are satisfied, and D is greater than H+5 mm.

In the embodiment, the inner sound insulation wall 51 and the outer sound insulation wall 52 of the gear box 5 are different in thickness, and the wavelength of the noise which can be absorbed is wider.

The gear box 5 in the embodiment is made of grey cast iron. The thickness of the inner sound insulation wall 51 is 20 mm. If the inner sound insulation wall is too thin, the noise absorption capability will be reduced greatly, and meanwhile, it is difficult to guarantee the quality during casting. If the inner sound insulation wall is too thick, the material cost and the unit weight will be increased. The thickness of the outer sound insulation wall 52 is 25 mm. Since the outer sound insulation wall needs to achieve a sound insulation effect and bears the pressure of the entire compressor as well, the thickness of the outer sound insulation wall 52 is greater than that of the inner sound insulation wall 51.

According to another aspect of the invention, a water chilling unit is provided, which comprises an above-mentioned centrifugal compressor.

The above is only the preferred embodiments of the invention, and is not intended to limit the invention. There can be various modifications and variations in the invention for those skilled in the art. Any modifications, equivalent replacements, improvements and the like within the spirit and principle of the invention shall fall within the protection scope of the invention.

The invention claimed is:

1. A centrifugal compressor, comprising:

an impeller (2);

a diffuser (3), the diffuser (3) comprising a pressurization passage (31), wherein air flows through the impeller (2) and enters an inlet of the pressurization passage (31);

a volute (8), configured to collect the air pressurized by the diffuser (3);

an exhaust diffuser pipe (9), fluidly connected with the volute (8), an extending direction of the exhaust diffuser pipe (9) inclining downwards with respect to a horizontal plane;

a gear box (5); and a coolant passage (4) configured to import a coolant from the outside, wherein the coolant passage (4) comprises:

a liquid spraying hole (41) provided at an inlet end of the pressurization passage (31);

a first flow guide hole (42) provided in an interior of a side wall of the gear box (5) and fluidly connected with the liquid spraying hole (41); and a second flow guide hole (43) configured to fluidly connect each of the plurality of liquid spraying holes (41) with the first flow guide hole (42).

2. The centrifugal compressor according to claim 1, wherein an angle between the extending direction of the exhaust diffuser pipe (9) and the horizontal plane is A, wherein $15° \leq A \leq 90°$.

3. The centrifugal compressor according to claim 2, further comprising:

a drive motor;

a spindle (6), mounted at the gear box (5), one end of the spindle (6) being connected with the impeller (2);

a first gear (7), mounted at the spindle (6);

a drive shaft, mounted at the gear box (5), the drive shaft being in drive connection with the drive motor;

a second gear, mounted at the drive shaft and meshing with the first gear (7); and a lubricating system, lubricating oil of the lubricating system being contained in a lower cavity of the gear box (5).

4. A water chilling unit, comprising the centrifugal compressor according to claim 2.

5. The centrifugal compressor according to claim 1, wherein a liquid spraying direction of the liquid spraying hole (41) is perpendicular to a flowing direction of the air in the pressurization passage (31).

6. The centrifugal compressor according to claim 5, further comprising:

a drive motor;

a spindle (6), mounted at the gear box (5), one end of the spindle (6) being connected with the impeller (2);

a first gear (7), mounted at the spindle (6);

a drive shaft, mounted at the gear box (5), the drive shaft being in drive connection with the drive motor;

a second gear, mounted at the drive shaft and meshing with the first gear (7); and a lubricating system, lubricating oil of the lubricating system being contained in a lower cavity of the gear box (5).

7. A water chilling unit, comprising the centrifugal compressor according to claim 5.

8. The centrifugal compressor according to claim 1, further comprising:

a drive motor;

a spindle (6), mounted at the gear box (5), one end of the spindle (6) being connected with the impeller (2);

a first gear (7), mounted at the spindle (6);

a drive shaft, mounted at the gear box (5), the drive shaft being in drive connection with the drive motor;

a second gear, mounted at the drive shaft and meshing with the first gear (7); and a lubricating system, lubricating oil of the lubricating system being contained in a lower cavity of the gear box (5).

9. The centrifugal compressor according to claim 8, further comprising a three-oil-wedge bearing configured to mount the spindle (6) and/or the drive shaft at the gear box (5).

10. The centrifugal compressor according to claim 8, wherein the diffuser (3) further comprises a first partition plate (32) and a second partition plate (33) parallel to the first partition plate (32), the first partition plate (32) comprising an annular base plate abutting against an outer side of the side wall of the gear box (5) and a plurality of flow guide plates vertically provided on a surface, opposites to the side wall of the gear box (5), of the base plate, the flow guide plates being uniformly provided in a circumferential direction of the base plate, and every two adjacent flow guide plates forming a corresponding pressurization passage (31); and the coolant passage (4) comprises a plurality of liquid spraying holes (41) corresponding to a plurality of pressurization passages (31), each pressurization passage (31) corresponding to at least one liquid spraying hole (41).

11. The centrifugal compressor according to claim 10, wherein the second flow guide hole (43) comprising a first hole-section (431) extending from an interior of the base plate to the side wall of the gear box (5) and second hole-sections (432) configured to fluidly connect the each of the plurality of liquid spraying holes (41) with the first hole-section (431); and the coolant passage (4) further comprises an elongated slot which is provided at the outer side of the side wall of the gear box (5) or which is provided at the surface, abutting against the outer side of the side wall of the gear box (5), of the first partition plate (32) and configured to fluidly connect the second hole-sections (432), the elongated slot being fluidly connected with the first flow guide hole (42).

12. The centrifugal compressor according to claim 8, wherein at least some of the box walls forming the gear box (5) are double-layer walls.

13. The centrifugal compressor according to claim 12, wherein each double-layer wall comprises an inner sound insulation wall (51) and an outer sound insulation wall (52) provided at an outer side of the inner sound insulation wall (51) at an interval, the thickness of the outer sound insulation wall (52) is D, and the thickness of the inner sound insulation wall (51) is H, where D is greater than H.

14. The centrifugal compressor according to claim 13, wherein D is greater than H+5 mm.

15. The centrifugal compressor according to claim 13, wherein D is greater than 20 mm and less than 30 mm, and H is greater than 15 mm and less than 25 mm.

16. A water chilling unit, comprising a centrifugal compressor according to claim 1.

* * * * *